US005097806A

United States Patent [19]

Vataru et al.

[11] Patent Number: 5,097,806

[45] Date of Patent: Mar. 24, 1992

[54] MULTI-MODE ENGINE CLEANING FLUID APPLICATION APPARATUS AND METHOD

[75] Inventors: Marcel Vataru, Los Angeles; James L. Baylor, Fontana, both of Calif.

[73] Assignee: Wynn Oil Company, Fullerton, Calif.

[21] Appl. No.: 696,493

[22] Filed: May 6, 1991

[51] Int. Cl.[5] ..... F02B 77/00

[52] U.S. Cl. ..... 123/198 A; 134/169 A

[58] Field of Search ..... 123/1 A, 198 A; 134/20, 134/22.1, 22.11, 22.19, 169 R, 169 A

[56] References Cited

U.S. PATENT DOCUMENTS

| | | | |
|---|---|---|---|
| 1,030,931 | 7/1912 | Silver | 123/198 A |
| 1,451,157 | 4/1923 | Gerbig | 123/198 A |
| 2,201,774 | 5/1940 | Hofele | 123/198 A |
| 2,281,695 | 5/1942 | James et al. | 123/198 A |
| 2,366,073 | 12/1944 | Vallerie | 123/198 A |
| 2,632,719 | 3/1953 | Tankersley | 134/24 |
| 2,644,440 | 7/1953 | Bailey, Sr. | 123/198 A |
| 2,888,913 | 6/1959 | Emmett et al. | 123/198 A |
| 3,106,194 | 10/1963 | Cantwell, Jr. et al. | 123/1 A |
| 3,148,670 | 9/1964 | Fiedler et al. | 123/198 A |
| 3,173,408 | 3/1965 | Brenneman | 123/119 |
| 3,211,377 | 10/1965 | Brenner | 239/1 |
| 3,224,684 | 12/1965 | Roosa | 239/533 |
| 3,318,096 | 5/1967 | Webb | 60/258 |
| 3,338,564 | 8/1967 | Roeder | 261/18 |
| 3,403,695 | 10/1968 | Hopkins | 137/240 |
| 3,589,388 | 6/1971 | Hameline, Jr. | 137/315 |
| 3,752,398 | 8/1973 | Svensson | 239/1 |
| 3,961,482 | 6/1976 | Jamaux | 123/198 A |
| 4,059,123 | 11/1977 | Bartos et al. | 134/169 A |
| 4,061,504 | 12/1977 | Zall et al. | 134/95 |
| 4,082,565 | 4/1978 | Sjolander | 134/1 |
| 4,161,160 | 7/1979 | Hicks et al. | 123/198 A |
| 4,167,193 | 9/1979 | Magnus et al. | 134/169 A |
| 4,190,346 | 2/1980 | Hutson et al. | 354/324 |
| 4,197,140 | 4/1980 | Swan | 123/198 A |
| 4,290,392 | 9/1981 | Dissmore | 123/198 A |
| 4,331,121 | 5/1982 | Stokes | 123/198 A |
| 4,346,689 | 8/1982 | Neely | 123/198 A |
| 4,516,547 | 5/1985 | Williams | 123/198 A |
| 4,520,773 | 6/1985 | Koslow | 123/198 A |
| 4,606,311 | 8/1986 | Reyes et al. | 134/169 A |
| 4,671,230 | 6/1987 | Turnipseed | 123/198 A |
| 4,784,170 | 11/1988 | Romanelli et al. | 123/198 A |
| 4,787,348 | 1/1988 | Taylor | 123/198 A |
| 4,989,561 | 2/1991 | Hein et al. | 134/169 A |

FOREIGN PATENT DOCUMENTS 1046597 12/1953 France .

*Primary Examiner*—Noah P. Kamen

*Attorney, Agent, or Firm*—William W. Haefliger

[57] ABSTRACT

The method of cleaning internal combustion engine fuel injector structure, valves and combustion chambers, and employing a canister containing a liquid mixture that includes engine fuel and injector cleaning solvent, the steps that include charging pressurized gas into the canister to a selected high-pressure level; communicating the interior of the canister with a passage extending to the injector structure and operating the engine to provide pressurized fuel discharge delivered to the passage; terminating operation of an engine fuel pump; continuing operation of the engine and flow of the mixture in the canister to the injector structure until the mixture in the canister depletes; and re-charging pressurized gas into the canister to a selected high-pressure level, and continuing flow of the mixture to the injector structure while the engine is running.

16 Claims, 2 Drawing Sheets

30
32

121a
120a
122
31
23
22
188
87
80a
86
120
80
85
84
79
83
78a
78
82
25
77
26
27
28
130
121
123
45
15
16
187
3
3
12a
10
21
46
12
13
46a

MULTI-MODE ENGINE CLEANING FLUID APPLICATION APPARATUS AND METHOD

BACKGROUND OF THE INVENTION

This invention relates generally to cleaning of internal combustion engine fuel injection nozzles, valves and combustion chambers, and more particularly to an easily used system and method wherein the amount of cleaning solution in a mixture of fuel and cleaning solution can be easily controlled and fed to such nozzles.

It is known to employ pre-packaged and pre-pressurized cartridges or containers of cleaning solution and fuel, in purge systems, for cleaning fuel injection equipment. See U.S. Pat. No. 4,784,170 to Romanelli. Such containers have inherent disadvantages that include loss of pressure as the container is used, and the inability to purge the preparation of cleaning solution or ingredient to fuel in the container.

There is need for an improved, easy to use system which does not encounter these disadvantages; there is need for a system wherein the preparation of cleaning solution to fuel being injected under pressure can be varied or selected to meet different cleaning requirements; and there is need for a multi-mode system as described herein.

SUMMARY OF THE INVENTION

It is a major object of the invention to provide an improved system and method that meets the above needs, and overcomes prior problems and disadvantages. Basically the method of the invention includes:

a) charging pressurized gas into a canister to a selected high-pressure level, b) communicating the interior of the canister with a passage extending to the injectors and operating the engine, including a fuel pump to provide pressurized fuel discharge which is delivered to the passage, c) terminating operation of the fuel pump, d) continuing operation of the engine by allowing substantially continuous pressurized flow of the mixture in the canister to the injectors, via the passage, and until the mixture in the canister has been substantially depleted, e) and, when pressure drops to a selected lower level, re-charging pressurized gas into the canister a selected high-pressure level, and continuing the communication of the canister interior with the passage to flow more of the mixture to the injectors while the engine is running.

Another object is to control timing of steps a), d) and e), as referred to, as by operation of a pressure regulator and by observation of a pressure gauge indicating the pressure in the canister. In this regard, step a) may be carried out by connecting an air pressure line in series with the canister, and disconnecting that line prior to step b).

Another object is to block discharge of the cleaning mixture from the canister after step a) and before step b), step a) typically involving only momentary charging of the canister to the upper pressure level. Likewise, step e) re-charging may be accomplished momentarily.

A further object is to provide air pressure supply ducting between the canister and a connection point to which the air pressure line is to be connected, and providing a check valve in the duct to block reverse flow of the mixture to the connection point. In this regard, a manually operable pressure relief valve may be connected in series with the canister, and operated to relieve any pressure in the canister prior to the additional step of charging the mixture into the canister.

Apparatus in accordance with the invention includes:

a) first means operatively connected with the canister for charging pressurized gas into the canister to a selected high-pressure level, b) second means operatively connected with the canister for communicating the interior of the canister with a passage extending to the injector means, thereby to effect operation of the engine by mixture flow to and through the injector means, and while the fuel pump is operating to deliver pressurized fuel to the passage, c) and third means for visibly displaying the pressure of the mixture as it flows from the canister to the passage both before and after terminating of fuel pump operation, whereby decrease of the mixture pressure to a selected lower level may be determined, d) and whereby the first means may then be employed for charging gas into the canister to a selected high-pressure level to effect flow of more of the mixture from the canister to the injector means.

These and other objects and advantages of the invention, as well as the details of an illustrative embodiment, will be more fully understood from the following specification and drawings, in which:

DRAWING DESCRIPTION

DETAILED DESCRIPTION

Figure 1:
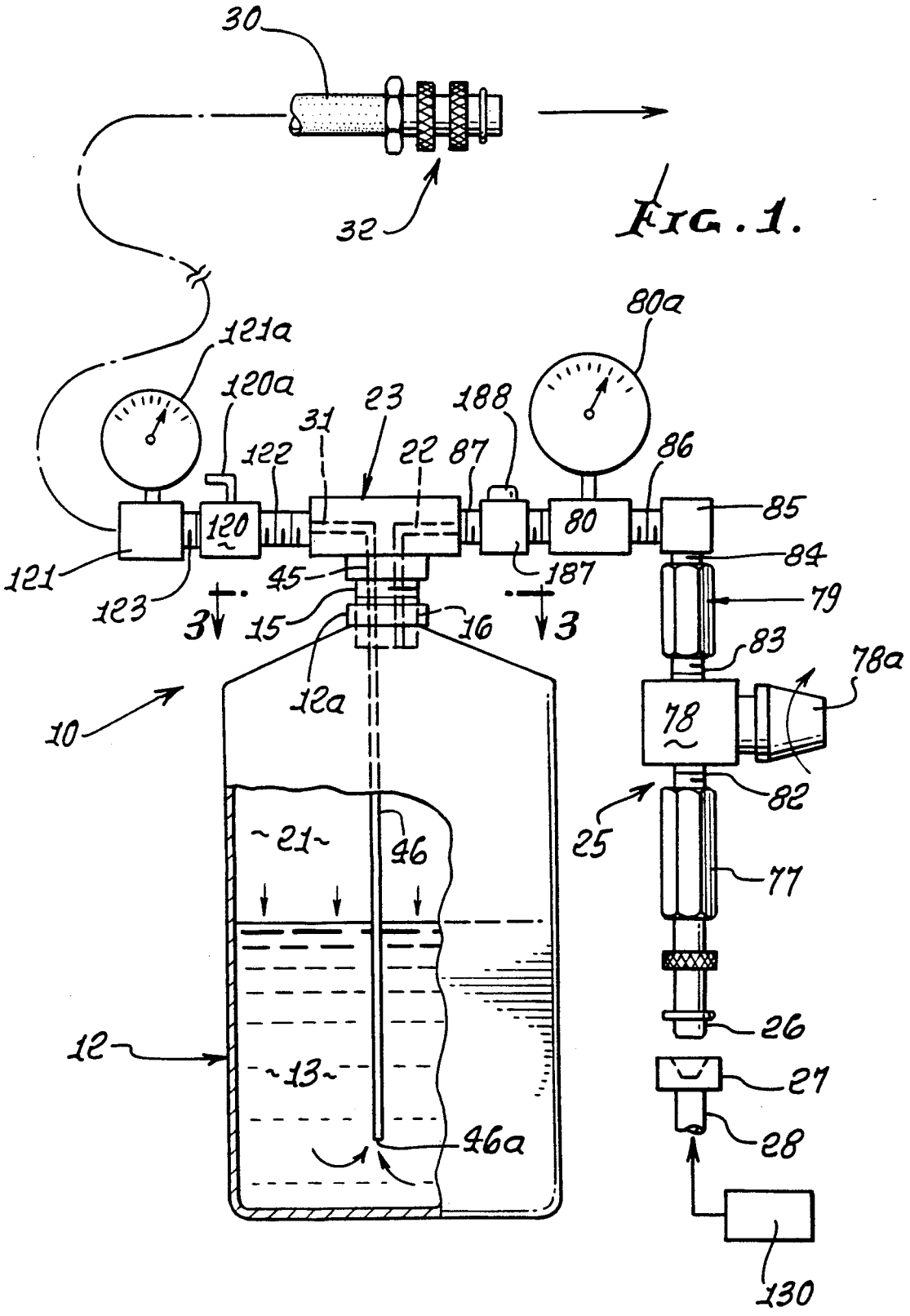
FIG. 1 is an elevation showing a system incorporating the invention.
Figure 2:
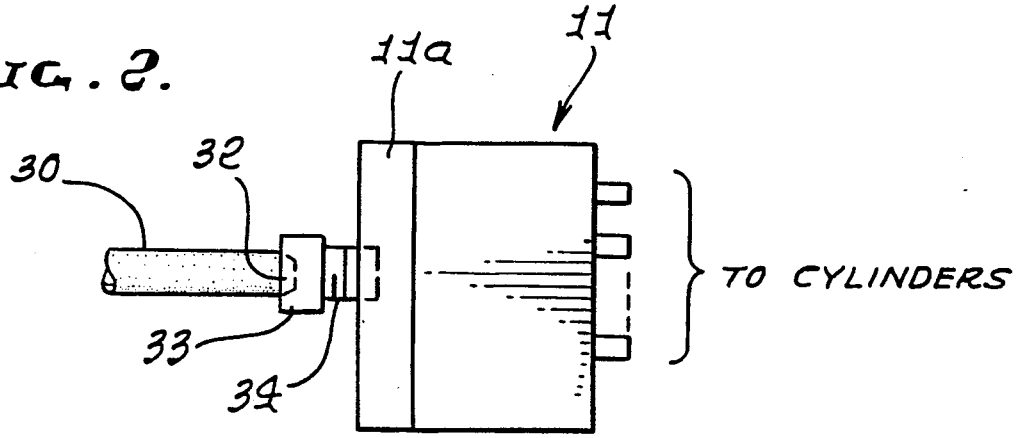
FIG. 2 is an elevation showing connection of the FIG. 1 cleaning fluid supply to an engine fuel injection rail.
Figure 3:
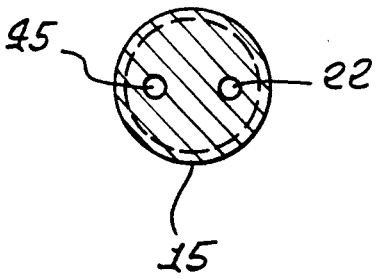
FIG. 3 is a section taken on lines 3—3 of FIG. 1.

Referring first to FIG. 1, apparatus 10 is shown to be used for cleaning or removing deposits formed upon the interior surfaces of internal combustion fuel injection means, generally indicated at 11 in FIG. 2. Such means may include nozzles, valves and combustion chambers. The apparatus 10 includes a canister or container 12 to receive a liquid mixture 13 that contains a cleaning solvent (such as Wynn's Valve, Injector, and Combustion Chamber Cleaner V.I.C.) adapted to dissolve or remove such deposits that may include carbon, hydrocarbon, lead, lead compounds, and the like. The apparatus is used to force the mixture under pressure through the fuel injectors as the engine is operating, and the mixture 13 typically contains cleaning solvent or a mixture of engine fuel and solvent. The proportions of these may be varied or selected, as by controlled filling of different liquid mixture components A, B and/or C into the container 12 after a threaded stem or cap 15 has been removed from the threaded mouth 16 of the container. In this way, the mixture 13 can be selected or tailored (more or less solvent) to the cleaning requirements of the injector means 11, including rail 11*a*. Stem 15 is normally attached to the container, as by the interfitting threading at neck 12*a*, as during pressurized feed of the mixture to the injector means 11.

A gas (as for example air) pressure supply duct 22 is provided in stem 15 to supply gas pressure to the space 21 above the mixture in the container, for exerting downward pressure on the mixture to force it to and through the injector means 11. Duct 22 extends upwardly in the stem and in T-shaper fitting 23 connected to a gas pressure supply line generally indicated 25. Line 25 has a fitting or coupling part 26 at its inlet end or point to telescopically fit a corresponding coupling part 27 in a gas pressure source line 28. That fitting may be a quick-disconnect fitting that includes male and female members that interfit. A one-way (i.e., check) valve 79 in line 25 opens when the quick disconnect members are interfitted, and closes when those members are separated, whereby pressure in space 21 is not lost upon such separation. See also pressure source 130.

Additional elements connected or connectible into line 25 include a filter 77, and a pressure regulator 78 connected in series between 26 and 79, and a pressure gauge tubular body 80 is connected between 79 and 23. Threaded ducts or piping interconnecting these elements are indicated at 82, 83, 84, 85, 86, and 87. A pressure relief valve 187 may be connected between 80 and 23, as shown. It is manually operable, as by pushing plunger 188 to relieve pressure in the connector at 21, such as prior to unscrewing stem 15 from neck 12*a* to enable filling of the canister.

A flexible delivery line 30 is provided to deliver the pressurized cleaning mixture from an outlet port 31 in the fitting 23 to the injector means 11. Port 31 receives fluid via ducting 45 in fitting 23 and via a tube 46 carried by 23, and extending downwardly into the mixture 13 to a lower level 46*a*, whereby air or gas pressure at 21 drives fluid up the tube 46 to port 31. Line 30 communicates with port 31 via a safety valve 120 and a second pressure gauge tubular body 121, series connections being shown at 122 and 123. Line 30 has a fitting or coupling part 32 at its outlet end to telescopically fit a corresponding coupling part 33 in a mixture delivery tube 34 associated with 11. See FIG. 2. That fitting may also be a quick-disconnect fitting that includes male and female members that interfit, and that are releasably held together as by a rotary coupling. One-way valves in parts 32 and 33 open when such parts are interfitted, and they close when those members are separated, whereby pressure in space 21 is not lost upon such separation, nor is remaining mixture in the container lost.

Gauge 121*a* registers the pressure in the delivery rail associated with 11, so that the operator can shut the safety valve 120 by turning handle 120*a* if the pressure exceeds a predetermined value or to prevent unwanted escape of fluid from the canister. Such escape might occur, for example, if the fitting 32 becomes disconnected from coupling part 33 during fluid delivery from the canister.

When filling the canister 12, liquid A may consist of fuel; liquid B may consist of solvent of one strength; and liquid C may consist of a different solvent, as for example a solvent of different strength or dissolving use (B may be a hydrocarbon solvent, and C may be a detergent/dispersant compound); and the mix of such components may be selectively varied and used in sequence or simultaneously, as required to achieve desired cleaning. In this manner, most efficient cleaning is achieved.

Figure 4:
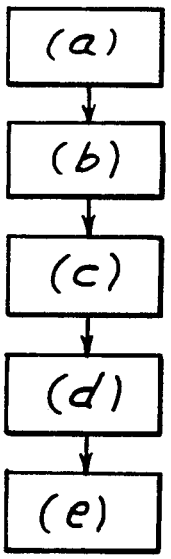
FIG. 4 is a method step flow diagram.

Manual pressure relief valve 187 is provided to relieve air pressure in the canister, prior to filling, as referred to. A safety valve may be provided at stem 15 to relieve such air or gas pressure when the stem is separated from the canister neck. Regulator 78, manually adjustable at 78*a*, is provided to control the pressure supplied to canister space 21, and a pressure-indicating gauge 80*a* allows visible displaying of gas pressure in the canister. The basic method of the invention includes the steps indicated at a)—e) in FIG. 4. These include:

a) charging pressurized gas into the canister to a selected high-pressure level, b) communicating the interior of the canister with a passage extending to the injector means and operating the engine, including a fuel pump to provide pressurized fuel discharge which is delivered to the passage, c) terminating operation of the fuel pump, d) continuing operation of the engine by allowing continuous pressurized flow of the mixture in the canister to the injector means, via the passage, until the mixture in the canister has become depleted, e) and, when pressure drops to a selected lower level, re-charging pressurized gas into the canister to a selected high-pressure level, and continuous the communication of the canister interior with the passage to flow more of the mixture to the injector means while the engine is running.

In addition, the pressure gauge 80*a* is observed during steps a), d) and e); and regulator 78 is adjusted, to determine the selected high pressure of step a), to determine when the pressure in the canister has dropped to selected lower level in step c), in order to control the initiation of step d), and to determine the arrival of pressure increase to selected high level.

Accordingly, the timing of the application of gas or air pressure in steps a) and e) may be facilitated, and such application may be momentary, the regulator 78 preventing overcharging.

An additional step may include blocking discharge of the mixture from the canister after the step a) and before the step b). This is effected by operation of the one-way valves in part 32 and at 79, as described above.

A detailed sequence of steps is listed as follows:

1. Fill the canister with selected A, B and/or C, and connect stem 15 into neck 12*a*.

2. Connect supply line 30 to engine fuel injector rail 16*a*, as by connecting 32 and 33.

3. Start vehicle engine, so that fuel injectors are now operated, along with engine fuel pump.

4. Pre-set regulator 78 (at 78*a*), with pressure source connected at 26 and 27, and observe regulated pressure at gauge 80*a*, to achieve identical, as indicated at gauge 121*a*.

4*a*. Disconnect 26 and 27 to remove air pressure source, the procedure only being an alternative to leaving air supply line attached.

5. Then disconnect fuel pump, and open safety valve 120 (at 120*a*) so that only A, B and/or C flow through injectors from the canister.

6. When cleaning mixture is depleted and engine stops, disconnect 26 and 27.

6*a*. Alternatively, when indicated pressure at gauge 80*a* drops from an upper level (say 35 psi) to a lower level (say 26 psi, for example), reconnect 26 and 27 (momentarily) to bring the pressure in the canister back up to the selected upper level, as determined by the regulator 78. Then disconnect 26 and 27.

The basic apparatus of the invention is defined as:

a) first means operatively connected with the canister for charging pressurized gas, such as air, into the canister to a selected high-pressure level, b) second means operatively connected with the canister for communicating the interior of the canister with a passage (such as rail 11) extending to the injectors, thereby to effect operation of the engine by fuel and solvent mixture flow to and through the injectors, and while the fuel pump is operating to deliver pressurized fuel to the passage, c) and third means for visibly displaying the pressure of the mixture as it flows from the canister to the passage both before and after terminating of fuel pump operation, whereby decrease of the mixture pressure to a selected lower level may be determined, d) and whereby the first means may then be employed for again charging gas into the canister to a selected high-pressure level to effect flow of more of the fuel and solvent mixture from the canister to the injectors.

We claim:

1. In the method of cleaning internal combustion engine fuel injector means, valves and combustion chambers, and employing a canister containing a liquid mixture that includes engine fuel and injector cleaning solvent, the steps including:

a) charging pressurized gas into the canister to a selected high-pressure level, b) communicating the interior of the canister with a passage extending to said injector means and operating the engine, including a fuel pump to provide pressurized fuel discharge which is delivered to said passage, c) terminating operating of the fuel pump, d) continuing operating of the engine by allowing substantially continuous pressurized flow of said mixture in the canister to said injector means, via said passage, and until the mixture in the canister depletes, and after pressure drops to a selected lower level, re-charging pressurized gas into the canister to a selected high-pressure level, and continuing said communication of the canister interior with said passage to flow more of said mixture to the injector means while the engine is running.

2. The method of claim 1 including connecting a pressure gauge in series with the canister and observing said gauge during said steps a), d) and e).

3. The method of claim 1 including blocking discharge of said mixture from the canister after said step a) and before said step b).

4. The method of claim 3 wherein said step a) is carried out by connecting an air pressure line in series with the canister, and including disconnecting said line prior to said step b).

5. The method of claim 4 wherein said step a) is controlled to occur according to one of the following:

momentarily continuously.

6. The method of claim 4 including providing supply ducting between the canister and a connection point to which the air pressure line is to be connected, and providing a check valve in said duct to block reverse flow of said mixture to the connection point.

7. The method of claim 6 wherein a pressure regulator is connected in series with said ducting, and including the step of operating said regulator to establish said step a) high-pressure level.

8. The method of claim 1 wherein a manually operable pressure relief is connected in series with said canister, and including operating said relief valve to relieve any pressure in the canister prior to said step of recharging said mixture into the canister.

9. An apparatus for cleaning internal combustion engine fuel injector means, the engine including a fuel pump, and employing a canister containing a liquid cleaning mixture that includes engine fuel and cleaning solvent, said apparatus comprising, in combination:

a) first means operatively connected with the canister for charging pressurized gas into the canister to a selected high-pressure level, b) second means operatively connected with the canister for communicating the interior of the canister with a passage extending to said injector means, thereby to effect operation of the engine by mixture flow to and through the injector means, and while the fuel pump is operating to deliver pressurized fuel to said passage, c) and third means connected with said second means for visibly displaying the pressure of said mixture as it flows from the canister to said passage both before and after terminating of fuel pump operation, whereby decrease of said mixture pressure to a selected lower level may be determined, d) and whereby said first means may then be employed for again charging gas into the canister to a selected high-pressure level to effect flow of more of said mixture from the canister to said injector means, e) said first means including gas pressure supply ducting extending between the canister and a first connection point to which a gas pressure line fitting is connectible, and fourth means connected with said gas pressure supply ducting for visibly displaying the pressure of said gas being charged into the canister, f) and a pressure relief valve connected in series with said gas pressure supply ducting, between said canister and said fourth means, g) said gas pressure supply ducting including threaded pipe sections connected between said first connection point and said fourth means, and between said pressure relief valve and said canister.

10. The combination of claim 9 wherein said third means includes a fluid pressure gauge connected in series with said canister.

11. The combination of claim 10 wherein said fourth means includes a fluid pressure gauge.

12. The combination of claim 11 including a check valve connected in said ducting between said first and second points to block reverse flow of said mixture to said first point, and while the pressure of gas in said ducting between said check valve and canister is displayed by said gauge.

13. The combination of claim 9 wherein said second means includes a flow line having an end, and a quick disconnect device at said end of said line.

14. The combination of claim 13 wherein said container has a removable plug containing a first port connected between gas pressure supply ducting and the interior of the canister, and a second port connected between the canister interior and said flow line.

15. The combination of claim 9 including a gas pressure regulator connected in series with said gas pressure supply ducting.

16. The combination of claim 9 wherein the canister has a cap, and including a mixture delivery line extending from the cap into the canister interior.

* * * * *